US005210963A

United States Patent [19]

Harwood

[11] Patent Number: 5,210,963

[45] Date of Patent: May 18, 1993

[54] MOLDED PLASTIC TOE CAP

[76] Inventor: John M. Harwood, 15140 Irene Ct., Elm Grove, Wis. 53122

[21] Appl. No.: 798,387

[22] Filed: Nov. 26, 1991

[51] Int. Cl.[5] ..... A43C 13/14

[52] U.S. Cl. ..... 36/77 R; 36/77 M; 36/72 R

[58] Field of Search ..... 36/77 R, 77 M, 72 R; 12/146 D

[56] References Cited

U.S. PATENT DOCUMENTS

| | | | |
|---|---|---|---|
| 2,740,209 | 4/1956 | Schultz . | |
| 3,045,367 | 7/1962 | McKeon | 36/72 R |
| 3,950,865 | 4/1976 | Gray | 36/77 R |
| 4,103,438 | 8/1978 | Fron . | |
| 4,257,177 | 3/1981 | Unsted . | |
| 4,656,761 | 4/1987 | Lord . | |
| 4,735,003 | 4/1988 | Dykeman | 36/77 R |

FOREIGN PATENT DOCUMENTS

| | | | |
|---|---|---|---|
| 0095061 | 11/1983 | European Pat. Off. | 36/77 R |
| 0100181 | 2/1984 | European Pat. Off. | 36/77 R |
| 2127275 | 4/1984 | United Kingdom | 36/72 R |
| 2138272 | 10/1984 | United Kingdom | 36/72 R |

*Primary Examiner*—Steven N. Meyers
*Assistant Examiner*—Marie D. Patterson
*Attorney, Agent, or Firm*—Andrus, Sceales, Starke & Sawall

[57] ABSTRACT

A toe cap for a protective shoe is injection molded utilizing a fiber-filled plastic resin having a high loading of relatively long fibers. The toe cap is constructed to provide a controlled vertical collapse of the body under a vertical load imposed on the roof by providing a roof section of relatively higher strength than the front and side walls of the toe cap. The front and/or side walls are provided with regions of substantially reduced cross section, as compared to the roof section, allowing the walls to close vertically and collapse in a hinge-like manner, while the relatively stronger roof substantially retains its original shape. A specially positioned and shaped gate allows the fiber-filled resin to be injected to form the toe cap in a manner resulting in the lateral orientation of the fibers across the roof to substantially enhance the strength thereof.

12 Claims, 3 Drawing Sheets

FIG. 1
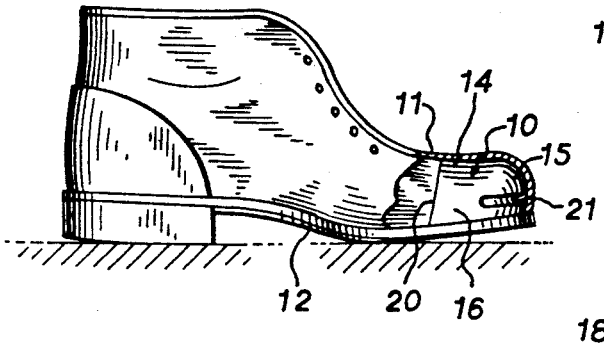
FIG. 2
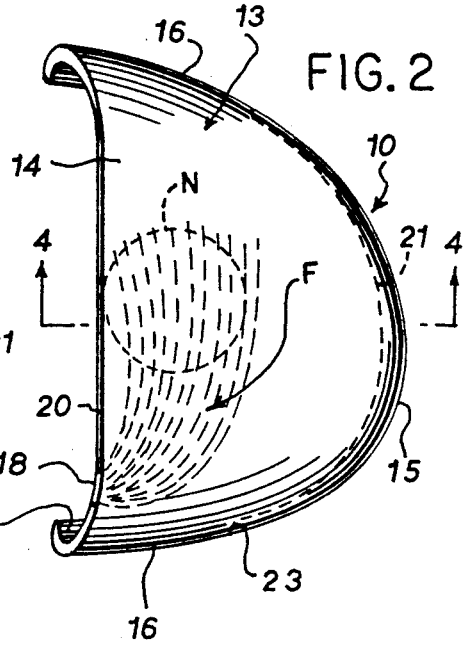
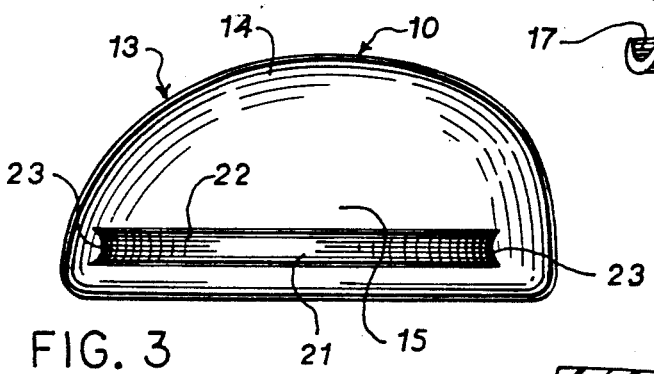
FIG. 3
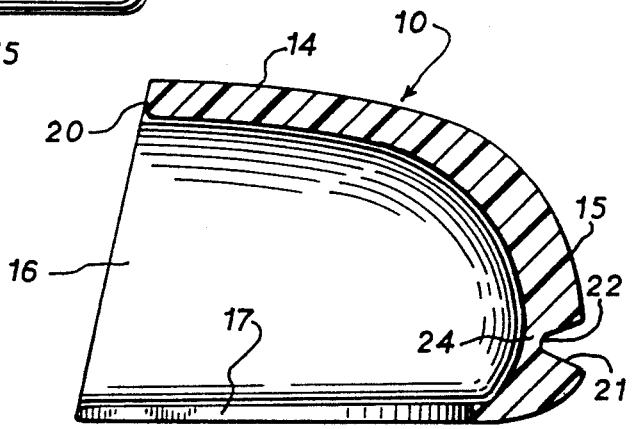
FIG. 4
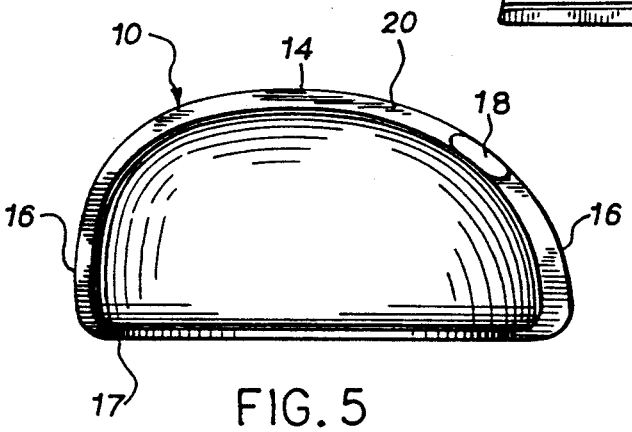
FIG. 5

FIG. 6
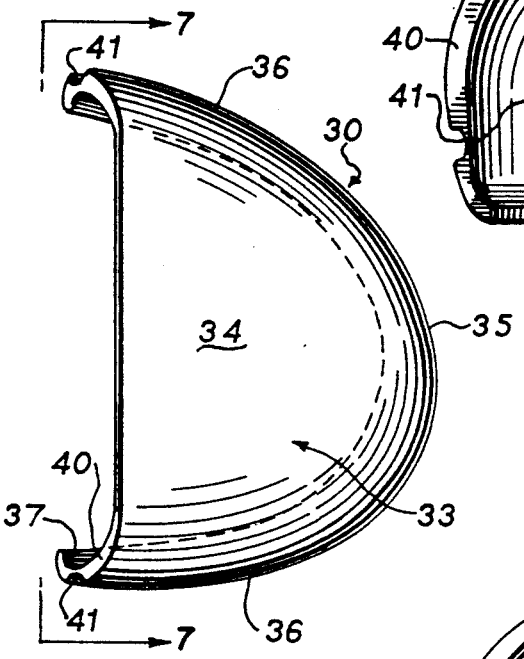
FIG. 7
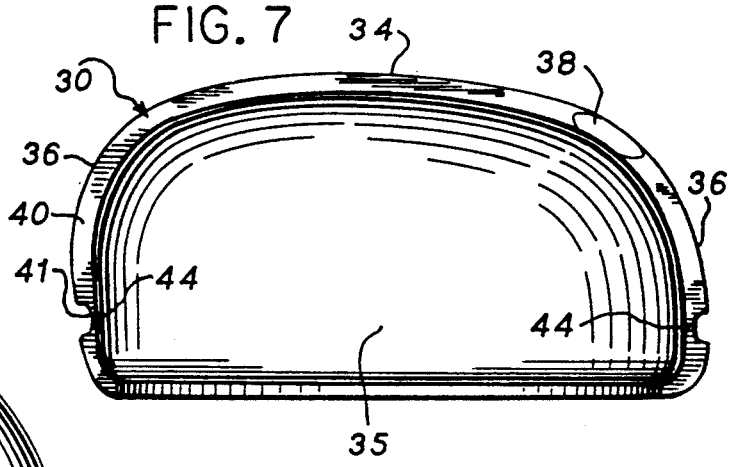
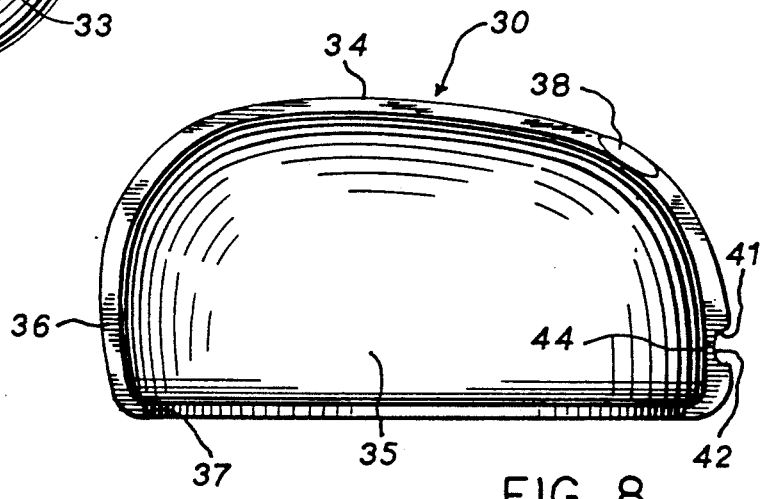
FIG. 8
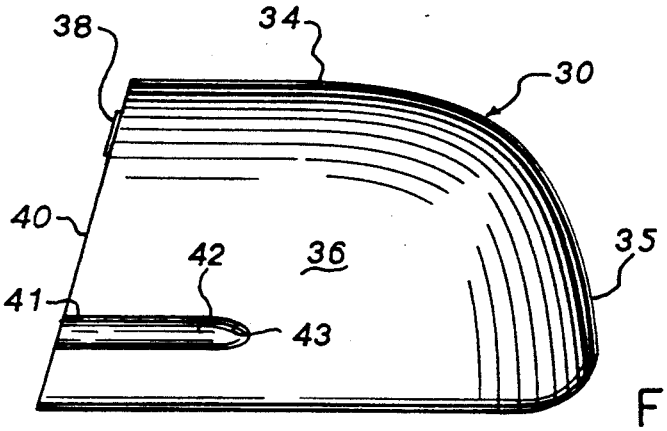
FIG. 9

FIG. 10
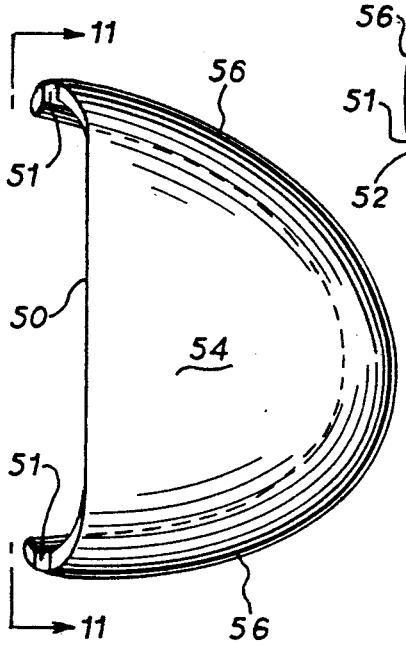
FIG. 11
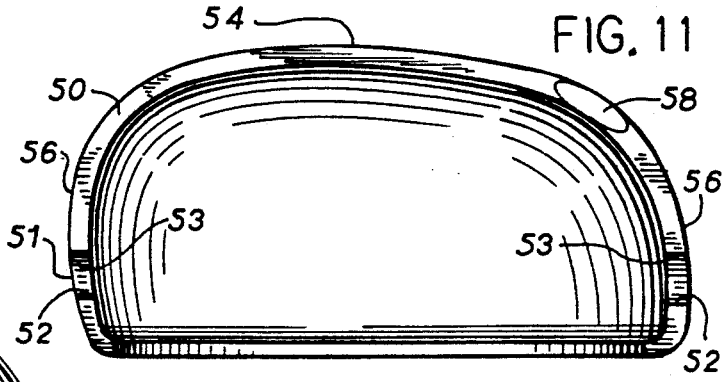
FIG. 12
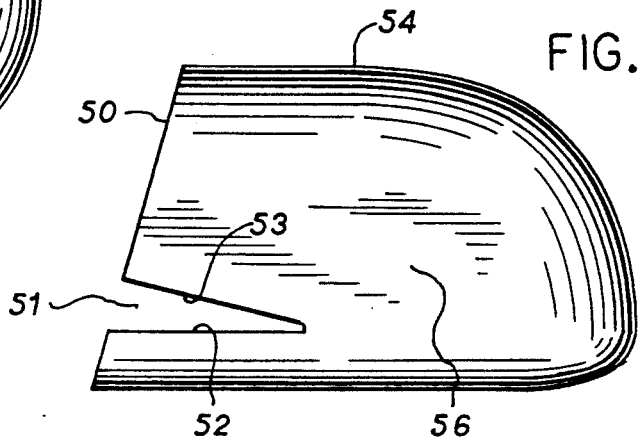
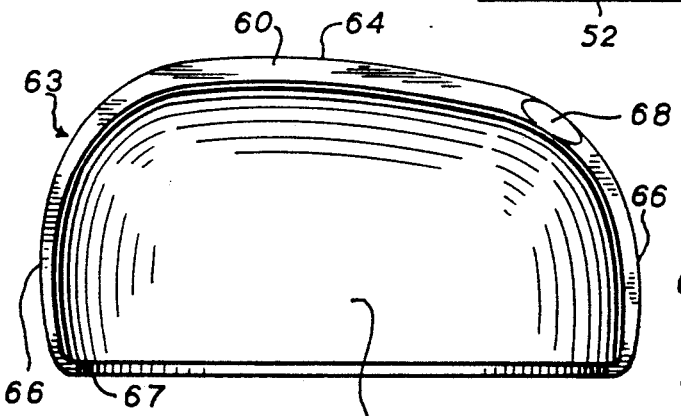
FIG. 13
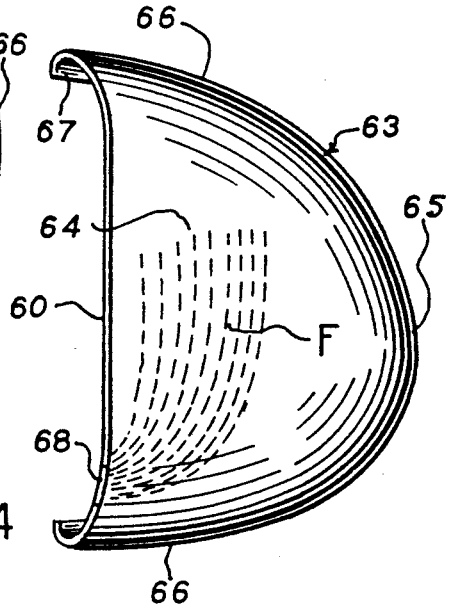
FIG. 14

MOLDED PLASTIC TOE CAP

BACKGROUND OF THE INVENTION

The present invention relates to a toe cap for a protective shoe and, more particularly, to a reinforced, injection molded plastic toe cap.

For many years, toe caps for protective shoes have been made of thin steel sheets formed into shoe toe-shaped bodies which are sewn or otherwise attached on the inside of the leather toe cap of a shoe or boot. Steel toe caps are known to deform under vertically applied compressive or impact loads and to undertake a permanent set which, if excessive, may result in a crushing and/or cutting injury to the toes of the wearer. Attempts have been made more recently to substitute various plastic materials for steel in safety toe caps and number of prior art patents show such constructions.

One of the more relevant prior art patents is Dykeman U.S. Pat. No. 4,735,003 which describes a molded plastic toe cap made of a variety of thermoplastic and thermosetting resins, both with and without fiber reinforcement. The body of the toe cap is provided with a flexible roof region, the deflection of which under load is intended to shift stresses to the lateral and forward wall regions which are generally heavier and more capable of supporting the loads.

In the United States, suitability of toe caps for new protective footwear is determined in accordance with American National Standard for Personal - Protection Protective Footwear (ANSI Z41-1991). This Standard provides, inter alia, for separate compression and impact tests, both of which apply vertical loads to the roof of the toe cap actually installed in a shoe or boot. Similar but somewhat more rigorous standards are applicable in Canada under Canadian Standards Association toe impact test Z-195 March 1984. In Europe, the test regimen is dictated by DIN standards.

The rigorous test regimens to which protective toe caps are subject has it made extremely difficult to design and build a toe cap of either steel or plastic which will consistently meet any one of the standards, much less all of them. The problem is exacerbated by variations in toe caps styles in the United States and between the United States, Canada and Europe. These styles are, in turn, dictated to some extent by variations in the styles and in the construction of shoes, both work shoes and dress shoes which are modified to include protective toe caps. There is also a desire in the industry to eliminate steel toe caps for reasons in addition to those mentioned above, such as the heat and electrically conductive properties of steel. Also, the response of steel to magnetic or electrical signals makes it undesirable for certain military and the like applications.

Thus, there is a continuing real need in the industry for a plastic toe cap to replace steel toe caps which will meet the applicable test standards and still meet the aesthetic requirements of style, shape and relatively light weight. In addition, molded plastic toe caps should desirably be capable of being made at high production rates, such as by injection molding. It is known, however, that prior injection molding techniques and materials using fiber-reinforced plastics are subject to fiber degradation and difficulty in fiber orientation necessary to optimize the strength of the final product.

SUMMARY OF THE INVENTION

In accordance with the present invention, the toe cap for a protective shoe is molded from a fiber-filled plastic resin in a manner to form a toe cap having a body of conventional shape in which the strength of the roof portion is enhanced relative to at least one of the side and front walls to provide a controlled vertical collapse of the roof under a vertical load thereon. Preferably, the reinforcing fibers are optimally oriented to maximize the resistance to failure under a conventionally applied vertical load. In addition, the toe cap walls are provided with regions of reduced cross section relative to the thickness of the roof which provide controlled collapse and failure under excessive loads in a manner providing further protection to the toes of the wearer.

The toe cap of the present invention may be molded to any conventional style and shape of toe cap and which includes a rearwardly opening shoe toe-shaped body having a roof which blends smoothly in curved transition regions into opposite lateral generally vertical side walls and a generally vertical front wall to define a conventional toe cap body. The body is made of a fiber-filled plastic resin having a major amount of the fibers in the resin which forms the roof of the body oriented in a lateral direction between the side walls. In addition, the body includes a region or regions of substantially reduced cross section located in at least one of the side and front walls, which region or regions assists in causing a controlled collapse of the toe cap under a vertical downward load imposed on the roof of the body.

In all of the presently preferred embodiments, the region of reduced cross section in one of the walls is formed with a generally elongate horizontal dimension which is greater than the vertical dimension of the reduced region. A further preferred construction includes a rear edge on the toe cap which defines a plane disposed at a rearwardly and downwardly sloping acute angle to the vertical. The rear edge is also the preferred location of the gate for admitting the molten plastic resin for making the toe cap by an injection molding process. Preferably, the gate opening is directly adjacent the rear edge of the body and along the transition region between the roof and one of the side walls.

In the most preferred embodiment, the region of reduced cross section comprises a slot which extends along the front wall and, in addition, extends along the curved transition regions between the front wall and the side wall and rearwardly into both side walls. In another embodiment, the region of reduced cross section includes a generally horizontal notch in one or both side walls, which notch or notches extend forwardly from the rear edge of the body. The notch may extend completely through the side wall or may comprise a groove or slot in either the outside or inside face of the side wall. The reduced cross section in the front wall or in the side walls may also be provided by a smooth transition in thickness from a relatively heavy-walled roof to relatively thinner front and/or side walls.

The use of a fiber-filled plastic resin and the preferred location of the injection molding gate allows the fibers in the injected plastic resin to orient in the preferred generally lateral direction in the roof of the body. The fiber-filled plastic resin preferably comprises a glass fiber-filled polyurethane. The glass fibers are preferably predominantly of a length greater than 0.25 inch and, more preferably, predominantly of a length of at least 0.5 inch. The glass fibers are preferably supplied in the range of about 50% to 65% by weight of the fiber-resin mixture.

BRIEF DESCRIPTION OF THE DRAWINGS

FIG. 1 is a side elevation, partly cut away, showing the installation of a toe cap of the present invention in a work shoe.

FIG. 2 is a top plan view of the presently preferred embodiment of the toe cap of the present invention.

FIG. 3 is a front elevation of the toe cap shown in FIG. 2.

FIG. 4 is an enlarged sectional view taken on line 4—4 of FIG. 2.

FIG. 5 is a rear elevation of the toe cap shown in FIG. 2.

FIG. 6 is a top plan view of a toe cap showing an alternate embodiment of the invention.

FIG. 7 is an enlarged rear elevation of the toe cap shown in FIG. 6.

FIG. 8 is an enlarged rear elevation, similar to FIG. 7, showing another embodiment.

FIG. 9 is a side elevation of the toe caps shown in FIGS. 7 and 8.

FIG. 10–12 are views similar to FIGS. 6, 7 and 9 showing a further variation in that alternate embodiment of the invention.

FIG. 13 is a rear elevation of a toe cap showing yet a further embodiment of the present invention.

FIG. 14 is a top plan view, slightly reduced in size, of the toe cap shown in FIG. 13.

DETAILED DESCRIPTION OF THE PREFERRED EMBODIMENTS

In FIG. 1, there is shown a conventional work shoe having installed therein a toe cap 10 of the present invention. In accordance with conventional shoe industry practice, the toe cap 10 is installed during manufacture of the shoe by placing the same over an inner liner and last (neither shown) and enclosing the toe cap in the shoe upper 11 which is subsequently attached to the shoe sole 12 in a conventional manner. Whether formed of sheet steel, molded of plastic, or made of some other material, toe caps all have a generally similar shape, although a number of different styles are utilized to accommodate varying shoe toe styles. In any event, the toe cap 10 is of generally the same shape as the upper toe portion of the shoe for which it is made.

Referring also to FIGS. 2–5, the toe cap 10 of the present invention comprises a unitary shoe toe-shaped body 13, including an upper roof 14 which slopes forwardly and laterally in a smooth continuous surface to blend into a front wall 15 and opposite lateral side walls 16. The toe cap body 13 is asymmetrical as is well known in the art. The front wall 15 and side walls 16 are generally vertical, however, they may be substantially curved over their entire extent, both vertically and horizontally, as shown. The side walls and front wall blend together to form a continuous outer wall and, in the embodiments shown, the continuous outer wall includes an integral inwardly turned narrow lip 17 along the entire lower edge of the body. The lip may be desirable to facilitate installation of the toe cap in the shoe, all in a manner well known in the art.

In accordance with the preferred embodiment of the invention, the toe cap 10 is injection molded using a plastic resin material having a high loading of reinforcing fibers. The toe cap is molded in a manner to preferentially orient the reinforcing fibers in the resin material which forms the roof 14 in a generally lateral direction between the opposite side walls 16. Referring particularly to FIG. 2, the preferred orientation of the reinforcing fibers F is shown schematically. It is believed that the preferred fiber orientation is uniquely attainable by proper sizing and location of the gate 18 (shown relative to the toe cap body itself) in the injection mold by which the toe caps are preferentially molded. By positioning the gate 18 on the rear edge 20 of the toe cap body, generally in the area of the curved transition between the roof 14 and one side wall 16, and by further widening the gate to spread the entry point for the fiber filled resin in a lateral direction, the preferential orientation of fibers F in the roof 14 is attained. By comparison, injection of a fiber-filled resin material through a gate in the rear edge 20 at the bottom of the side wall 16 near the lip 17 results in a swirling of the fibers and a generally random directional orientation in the roof 14. Similarly, injecting the plastic at the lower edge on the center of the front wall 15 also results in a swirling and a more random directional orientation of the fibers. Apart from the preferred orientation of the fibers F in the roof 14, fiber orientation elsewhere in the toe cap is not believed to be particularly important.

The preferential lateral orientation of the fibers F provides an optimally reinforced roof 14 in the toe cap which has been found to enhance substantially the resistance of the roof to failure under a vertical compressive or impact load and to further enhance the resilience of the structure, allowing it to bounce back after the imposition of a heavy vertical load. As shown in FIG. 2 and in accordance with the ANSI test standard identified above, a 50 pound (22.7 kg) load is attached to a flat one inch (25.4 mm) nose N which is dropped onto the roof 14 from a height of approximately 18 inches (45.7 cm) or a height sufficient to provide an impact velocity of 118 inches per second (approximately 3 m/sec). Toe caps 10 made in accordance with the present invention have been found to successfully pass two consecutive impact tests performed under the above standard.

The preferred embodiment of the toe cap of the present invention includes a region of substantially reduced cross section in the front wall 15 specifically comprising an elongate generally horizontal slot 21 extending along the entire front wall 15 and rearwardly along and into portions of both side walls 16. The slot 21 may be formed in any convenient manner, but is most conveniently formed in an injection molded part with a simple mold insert.

It has been found that the reduced section 24 in the front end portions of the side walls provided by the slot 21 results in a controlled collapse of the toe cap under a vertically imposed load (such as provided by impact of the nose N), particularly when combined with the preferred orientation of the reinforcing fibers F. One fiber filled plastic resin material which has been found to work well is a glass-filled polyurethane supplied by Polymer Composites Incorporated and carrying the designation PUG60.

Examination of test toe caps of the present invention, incorporated into actual shoe construction and tested in accordance with the above identified ANSI standard, and the more rigorous Canadian standard, shows a consistent performance characterized by a cracking of the roof 14, along with a visible stressed area or cracking in and along the slot 21, resulting in a temporary collapse of the roof under load, but a collapse which is within the range permitted by the respective test regimens, and a subsequent rebound of the plastic material to essentially its original shape. More specifically, the characteristic crack in the roof 14 typically forms generally along the longitudinal centerline of the roof directly under the point of impact and extends from the rear edge 20 forwardly and downwardly into the front wall 15. Thus, the crack is disposed generally perpendicular to the orientation of the fibers F in the roof 14. Simultaneously and dependent on the magnitude of the imposed load, either an area of visible stressing or a generally horizontal crack also typically occurs in the base 22 of the slot 21 at the point of thinnest cross section. The crack in the slot 21 may progress along its full length and even extend beyond the ends 23 of the slot and horizontally along the side walls 16. Although an obvious material failure is indicated when cracking occurs, the roof 14 of the toe cap will still bound back after impact and resume substantially its original shape. Often, a subsequent test performed immediately on an initially cracked toe cap will also pass the test even though further cracking or fracturing of the roof and extended cracking of the side walls may occur.

It is believed that the slot 21 in the front wall 15 results in a hinge-like effect that allows a downward tilting of the toe cap simultaneously with a generally vertical downward movement of the roof in a manner which controls the overall collapse of the toe cap to keep it within the range of movement permitted under the applicable test standard. In particular, it is important to prevent excessive downward movement and rearward tilting of the rear edge 20 to an extent which would result in the rear edge cutting into the toes of the wearer. The controlled collapse of the toe cap of the present invention obviates this problem.

In addition, it has been found helpful to form the rear edge 20 of the toe cap at an angle to define a plane generally disposed to slope rearwardly and downwardly at an acute angle to the vertical, as best shown in FIGS. 2 and 4. This angled rear edge 20 extends the base of the toe cap along the lower edges of side walls 16 to provide added stability against any tendency of the toe cap to tilt rearwardly. The actual angle at which the plane defining the rear edge 20 is disposed is not believed to be critical and as large an angle as possible, dictated primarily by requirements of the shoe manufacturing process, is desirable.

In FIGS. 6–9, there are shown two variations of another embodiment of the region of reduced cross section which helps provide the controlled collapse of the toe cap. In this embodiment, a toe cap 30 is of generally the same shape as the toe cap 10 of the preferred embodiment, but is made to accommodate a slightly different shoe style. The toe cap 30 has a unitary body 33 defined by a smooth blending of a roof 34, a front wall 35, and opposite side walls 36. The walls 35 and 36 may define, at their lower edges, a continuous lip 37. The fiber-filled plastic resin may be injected through a gate region 38 sized and positioned in a manner similar to the gate 18 of the preferred embodiment, resulting in the same preferred orientation of the fibers in the roof 34.

In lieu of the forwardly positioned slot 21 of the preferred embodiment, the alternate embodiment shown in FIGS. 6, 7 and 9 includes a slot 41 in each of the side walls 36 extending forwardly from the rear edge 40 of the body 33 toward the front wall 35. The slots 41 may be of any convenient shape to provide the regions of reduced cross section along the lower edges of the side walls 36 as shown. In the variation shown in FIG. 8, only a single slot 41 is provided in one side wall 36.

Under a vertically imposed compressive or impact load, the slot or slots 41 result in a similar collapse of the toe cap 30 as results from the slot 21 in the preferred embodiment of the toe cap 10. The roof 34 collapses downwardly in the same manner and is characterized by the same generally centered longitudinal crack in the roof perpendicular to the laterally oriented fibers F. Simultaneously, the slot or slots 41 allow the side wall or walls 36 to collapse about the reduced cross section 44 therein, also characterized by a horizontal crack running along the slot 41 in the base 42 of the slot. The crack may extend forwardly beyond the slot end 43 toward the front wall 35. In other words, the reduced cross section 44 acts as a hinge allowing the slots 41 to close vertically under load.

In FIGS. 10–12, there is shown a variation in the slots 41 of the embodiments shown in FIGS. 6–9. In the embodiment illustrated in FIGS. 10–12, the regions of reduced cross section in the side walls 56 comprise a pair of slots 51, each extending forwardly from the rear edge 50 of a side wall 56. Each slot 51 extends laterally through the full thickness of the side wall 56. In the particular construction shown, each slot includes a generally horizontal bottom wall 52 and a sloping top wall 53. The slots 51 allow the roof 54 of the toe cap to collapse vertically under a vertically imposed load in a manner similar to the embodiment in FIGS. 6–9. A similarly sized and positioned gate 58 is also preferably provided to enhance the orientation of the fibers in the roof 54.

In FIGS. 13 and 14, another embodiment of the toe cap of the present invention includes a body 63 having a shape similar to those shown in FIGS. 2 and 6. However, the regions of reduced cross section in the side walls 66 and/or front wall 65 are provided by molding the side wall 66 and/or front wall 65 with substantially thinner cross sections than the thickness or cross section of the roof 64. As may best be seen in FIG. 13, the relatively thick section of the roof 64 tapers laterally and downwardly in the regions of transition into substantially thinner side walls 66. The side walls 66 terminate at their lower edges in a continuous lip 67. The front wall 65 is preferably similarly thinned, as are the side walls 66, to provide a region of continuous reduced cross section around the entire periphery of the toe cap. As in the previously described embodiments, a gate 68 is positioned in the rear edge 60 and sized to result in the preferred orientation of the reinforcing fibers F laterally across the roof 64 between the side walls 66. Under a vertically imposed load on the roof 64, the reduced sections of the side walls 66 (and front wall 65 of similarly reduced section) result in the same controlled vertical collapse of the toe cap body 63, as previously described.

The presently preferred polyurethane base material identified above includes a glass fiber loading of about 60% by weight of the total glass-filled plastic resin. The fibers have an average length of ½ inch (12.7 mm), but fiber lengths as short as ¼ inch (6.4 mm) have been found to be satisfactory. Glass fiber loadings in the range of 40 to 65% by weight are believed to be suitable, depending on various additional factors such as toe cap wall thickness variations. In the toe caps shown and tested in accordance with the foregoing description, wall and roof thicknesses vary within a range of about ⅛ inch to about ¼ inch (3.2 mm to 6.4 mm).

The unique gate 18 or 38 which permits the preferred lateral orientation of the fibers in the roof 14 or 34, is also believed to prevent excessive fiber degradation by virtue of its laterally extended length. As shown, the gate 18 or 38 may be ½ inch (12.7 mm) in length or longer which may be two or more times greater than the wall thickness at the point of injection.

Various modes of carrying out the present invention are contemplated as being within the scope of the following claims particularly pointing out and distinctly claiming the subject matter which is required as the invention.

I claim:

1. An injection molded toe cap for a protective shoe of the type having a rearwardly opening shoe toe-shaped body including a roof which blends smoothly into opposite lateral generally vertical side walls and a generally vertical front wall, and an open rear end defined by a rear edge including the rear edges of the roof and side walls, said toe cap comprising:

a fiber-filled plastic resin body having a major portion of the fibers contained in the part of the resin body forming the roof oriented in a generally lateral direction between the side walls; and, means for increasing the strength of the roof of the toe cap relative to the front wall to provide a controlled vertical collapse of the body under a vertical load imposed on the roof, said means comprising an elongate generally horizontal slot defining a region in said front wall of substantially reduced cross section relative to the thickness of the roof.

2. A toe cap as set forth in claim 1 wherein said slots extends rearwardly from one end into one of the side walls.

3. An injection molded toe cap for a protective shoe of the type having a rearwardly opening shoe toe-shaped body including a roof which blends smoothly into opposite lateral generally vertical side walls and a generally vertical front wall, and an open rear end defined by a rear edge including the rear edges of the roof and said walls, said toe cap comprising:

a fiber-filled plastic resin body having a major amount of the fibers in the resin portion forming the roof forwardly from the rear edge oriented in a generally lateral direction between the side walls; and, gate means in the rear edge of the body positioned generally between the roof and one side wall for admitting the fiber-filled plastic resin to form the injection molded body.

4. A toe cap as set forth in claim 3 wherein said gate opening has a length along said rear edge substantially greater than the thickness of the body at said opening.

5. A molded toe cap for a protective shoe of the type having a rearwardly opening shoe toe-shaped body including a roof which blends smoothly in curved transition regions into opposite lateral generally vertical side walls and forwardly from a rear edge into a generally vertical front wall, said toe cap comprising:

a fiber-filled plastic resin body having a major amount of the fibers in the resin forming a major portion of the roof forwardly from the rear edge oriented in a generally lateral direction between the side walls;

means comprising a slot extending along the front wall defining a region of substantially reduced cross section in the front wall for causing a controlled collapse of the toe cap as a result of a vertical downward load imposed on the roof; and, a continuous rear edge extending from the lower end of one side wall upwardly and along the rear edge of the roof to the lower end of the other side wall, said rear edge defining a plane disposed at a rearwardly and downwardly sloping acute angle to the vertical.

6. A toe cap as set forth in claim 5 wherein said body is injection molded and including gate means in the injection mold for causing the fibers in the injected plastic resin to orient in said generally lateral direction.

7. A toe cap as set forth in claim 6 wherein said gate means comprises an elongate gate opening adjacent the rear edge of the body and along the transition region between the roof and one side wall.

8. A toe cap as set forth in claim 7 wherein said fiber-filled plastic resin comprises a glass fiber-filled polyurethane.

9. A toe cap as set forth in claim 8 wherein said glass fibers are predominantly of a length greater than 0.25 inch.

10. A toe cap as set forth in claim 9 wherein said glass fibers are predominantly of a length of at least 0.5 inch.

11. A toe cap as set forth in claim 10 wherein said glass fibers are in the range of about 40 to 65% by weight of the total fiber-resin mixture.

12. A method for molding a toe cap for a protective shoe, said cap having a rearwardly opening shoe toe-shaped body including a roof which blends smoothly into opposite lateral generally vertical side walls and a generally vertical front wall, and an open rear end defined by a rear edge including the rear edges of the roof and side walls, said method comprising the steps of:

(a) preparing a mold having a cavity conforming to the shape of the toe cap;

(b) injecting a molten fiber-filled plastic resin under pressure into the mold with a resin injection gate in direct communication with the portion of the mold cavity defining the rear edge of the toe cap between the roof and one side wall to fill the cavity and to cause a major amount of the fibers in the resin forming the roof forwardly from directly adjacent the rear edge to be oriented in a generally lateral direction between the side walls; and, (c) providing said mold cavity with a portion defining a region in the front wall of the cap of substantially reduced cross section relative to the thickness of the roof.

* * * * *